US007318482B2

(12) United States Patent
Kulhanek

(10) Patent No.: US 7,318,482 B2
(45) Date of Patent: Jan. 15, 2008

(54) BALANCED CONTINUOUS WELL STRING INJECTION UNIT

(75) Inventor: Emanuel Kulhanek, Surrey (CA)

(73) Assignee: C-Tech Oilwell Technologies Inc., Edmonton (CA)

( * ) Notice: Subject to any disclaimer, the term of this patent is extended or adjusted under 35 U.S.C. 154(b) by 271 days.

(21) Appl. No.: 11/138,892

(22) Filed: May 26, 2005

(65) Prior Publication Data

US 2006/0266528 A1 Nov. 30, 2006

(51) Int. Cl.
*E21B 33/00* (2006.01)

(52) U.S. Cl. ..... 166/380; 166/77.2; 166/77.3

(58) Field of Classification Search ..... 166/380, 166/77.2, 77.3
See application file for complete search history.

(56) References Cited

U.S. PATENT DOCUMENTS

| | | | | |
|---|---|---|---|---|
| 3,285,485 | A | 11/1966 | Slator | |
| 3,313,346 | A | 4/1967 | Cross | |
| 3,373,818 | A | 3/1968 | Rike et al. | |
| 3,559,905 | A | 2/1971 | Palynchuk | |
| 4,515,220 | A | 5/1985 | Sizer et al. | |
| 4,585,061 | A | 4/1986 | Lyons, Jr. | |
| 5,133,405 | A | 7/1992 | Elliston | |
| 5,188,174 | A | 2/1993 | Anderson, Jr. | |
| 5,309,990 | A | 5/1994 | Lance | |
| 5,553,668 | A | 9/1996 | Council et al. | |
| 6,015,015 | A * | 1/2000 | Luft et al. | 166/384 |
| 6,059,029 | A | 5/2000 | Goode | |
| 6,332,501 | B1 | 12/2001 | Gipson | |
| 7,182,140 | B2 * | 2/2007 | Wood | 166/379 |
| 2003/0034162 | A1 | 2/2003 | Kulhanek | |
| 2004/0118573 | A1 | 6/2004 | Schroeder | |

* cited by examiner

*Primary Examiner*—William P Neuder
(74) *Attorney, Agent, or Firm*—Christensen O'Connor Johnson Kindness PLLC

(57) ABSTRACT

A continuous well string injection unit and balancing system, in which the continuous well string injection unit is suspended using a sling connected to a pair of suspension points. The balancing system comprises a length-adjustable member connected to the rod injector at a third suspension point, and a controller for adjusting the length of the length-adjustable member.

10 Claims, 3 Drawing Sheets

BALANCED CONTINUOUS WELL STRING INJECTION UNIT

BACKGROUND OF THE INVENTION

This invention relates to the stabilization of continuous feed injection units that inject coiled rod into wellbores during wellsite operations. Units such as those discussed in published U.S. patent application Ser. No. 09/898,679, published as Publication No. 20030034162 on Feb. 20, 2003 and U.S. patent application Ser. No. 10/329,297, published as Publication No. 20040118573 on Jun. 24, 2004, may be hung from a servicing rig using a sling. However, because the center of gravity of the rod injector does not correspond with the location of the rod, it is necessary to manually move the rod injector over the wellbore until the rod has been inserted.

SUMMARY OF THE INVENTION

There is therefore provided a continuous well string injection unit arranged for balanced suspension from a rig, and a method of using the same.

According to an aspect of the invention, there is provided a continuous well string injection unit that is suspended unbalanced from a sling using two suspension points, and balanced by a support system. The support system may connect to a third suspension point on an overweighted side of the continuous well string injection unit. The third suspension point may be connected to a support member or positioner. The positioner may be a length-adjustable member, such as a pneumatic air cylinder and a cable, connected to the continuous well string injection unit. The positioner length is adjusted during installation of the continuous well string injection unit to balance the injection unit over a well.

These and other aspects of the invention are set out in the claims, which are incorporated here by reference.

BRIEF DESCRIPTION OF THE FIGURES

Preferred embodiments of the invention will now be described with reference to the figures, in which like reference characters denote like elements, by way of example, and in which.

DETAILED DESCRIPTION OF PREFERRED EMBODIMENTS

In the claims, the word "comprising" is used in its inclusive sense and does not exclude other elements being present. The indefinite article "a" before a claim feature does not exclude more than one of the feature being present.

Figure 1:
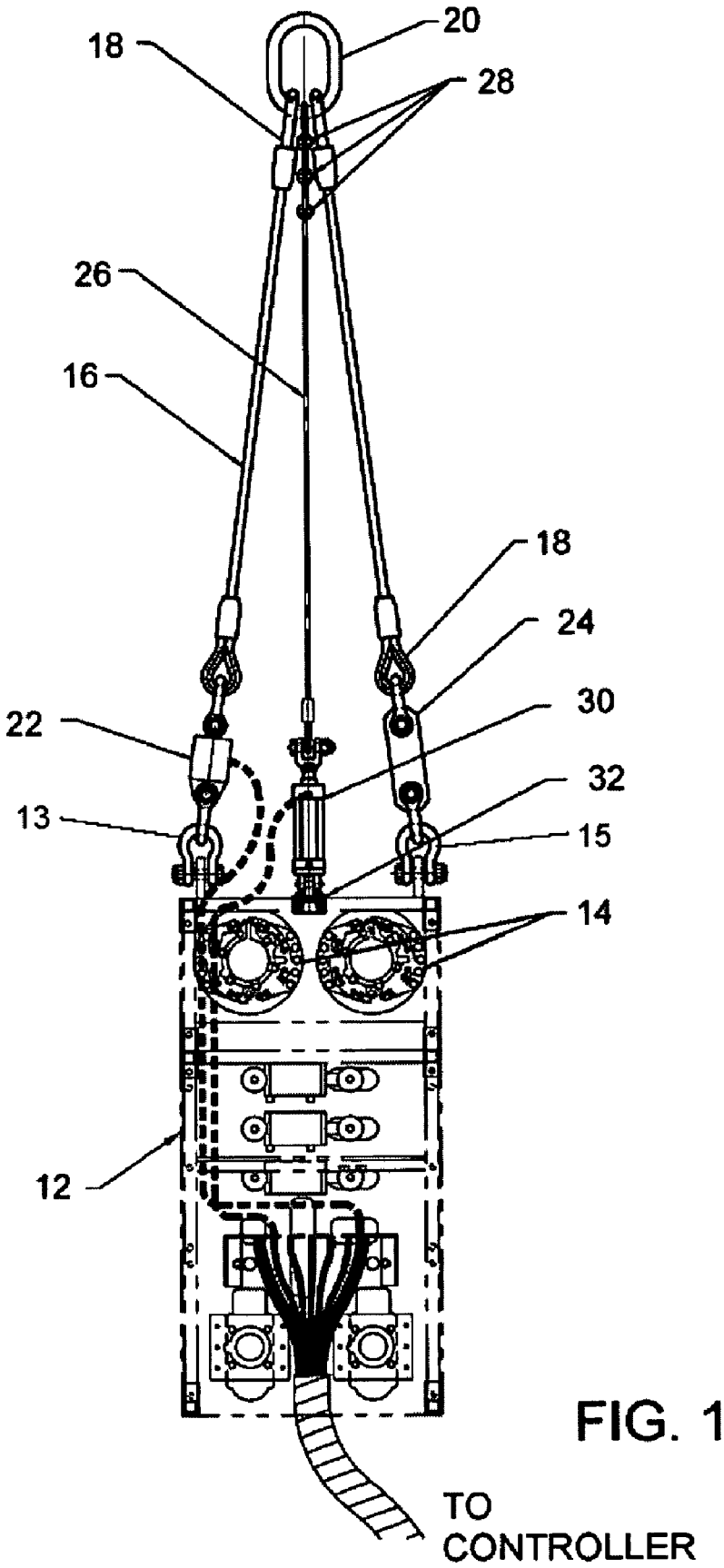
FIG. 1 is a front view of a continuous well string injection unit with a positioner.
Figure 2:
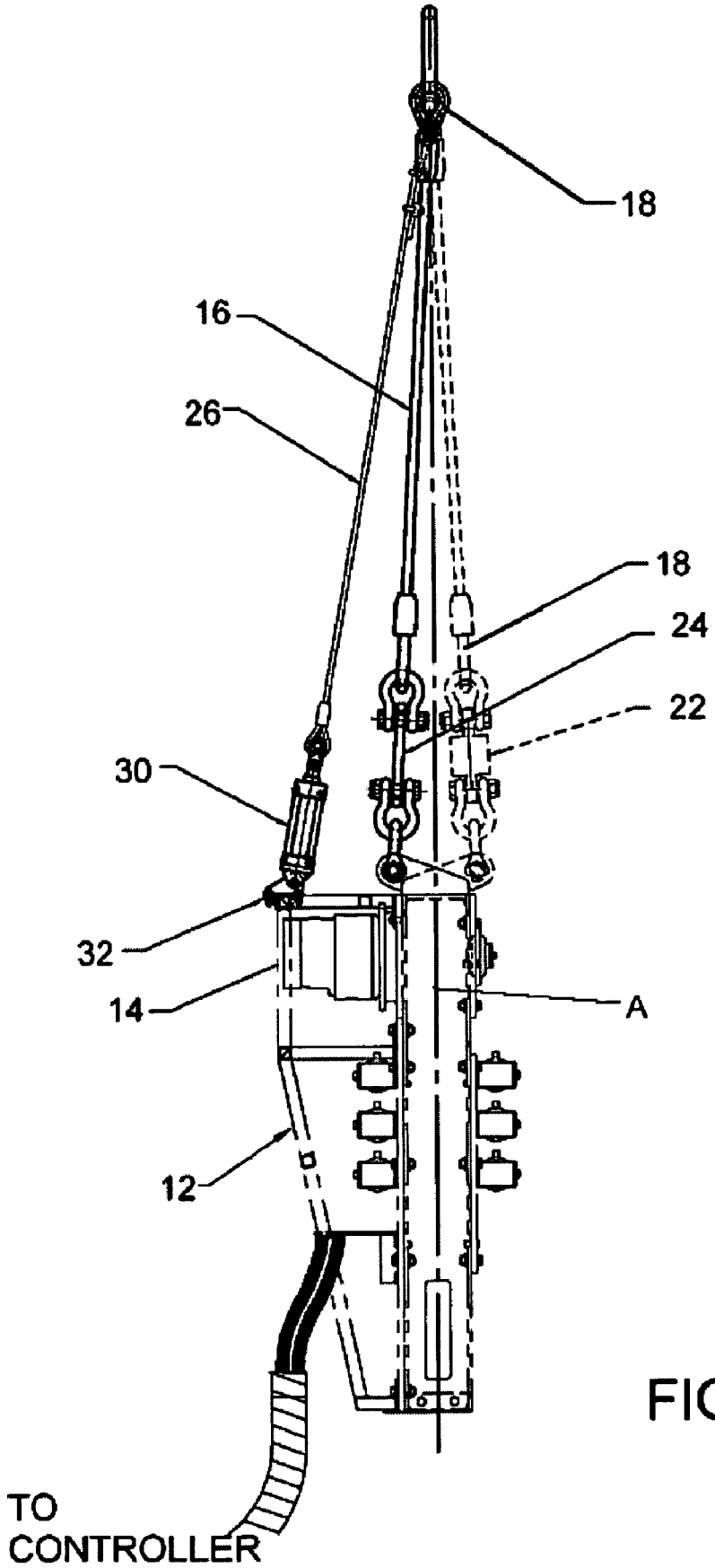
FIG. 2 is side view of the continuous well string injection unit in FIG. 1.

Referring now to FIGS. 1 and 2, there is shown a continuous well string injection unit, or rod injector 12 for manipulating coiled rod in a wellbore during servicing operations. There are two motors 14 for either injecting or removing coiled rod from a well (not shown). The coiled rod is manipulated by chains with gripper pads (not shown) that grip the coiled rod and the chains are driven by motors 14. The continuous well string injection unit 12 is suspended from a pair of suspension points 13 and 15. The continuous well string injection unit 12 has a central axis A along which continuous well string is driven by the continuous well string injection unit during operation. Motors 14 are hydraulically operated and as shown in FIG. 2 are on one side of the continuous well string injection unit 12 in relation to the suspension points 13, 15, which overweights one side of the continuous well string injection unit 12. The continuous well string injection unit 12 is hung from a rig using a sling 16 that connects to the suspension points 13, 15. The sling 16 may be made up of, for example, a two-leg bridle, with thimble eyes 18 at each end that attach to an oblong ring 20 at the top. Oblong ring 20 will then be attached to a servicing rig (not shown). Sling 16 also includes a load cell 22 on one leg and a spacer bar 24 on the other. The load cell 22 is used by the operator to determine the weight pulled by the injection unit 12, and is not necessary for the balancing of the injection unit 12 as described here. The overweighting of one side of the continuous well string injection unit 12 by the motors 14 will unbalance the continuous well string injection unit 12 such that the axis A of the continuous well string injection unit will not align with a well into which continuous well string is to be injected.

Referring further to FIGS. 1 and 2, a balancing system is provided for the continuous well string injection unit 12. A positioner or support member 26 connects to continuous well string injection unit 12 at a support point or suspension point 32 on the overweighted side of the continuous well string injection unit 12, which is outside the plane created by sling 16. For convenience, positioner 26 may also be attached to oblong ring 20 at the top using wire clips 28. Positioner 26 includes a cable 27 or wire rope and a pneumatic cylinder 30 that can be extended and retracted using a controller. Pneumatic cylinder 30 is shown in the fully retracted position in FIG. 2, causing the axis A of the continuous well string injection unit 12 to be fully aligned with a well. The length of cable 26 is set so that full retraction of cylinder 30 corresponds to vertical alignment of the injection unit 12.

Figure 5:
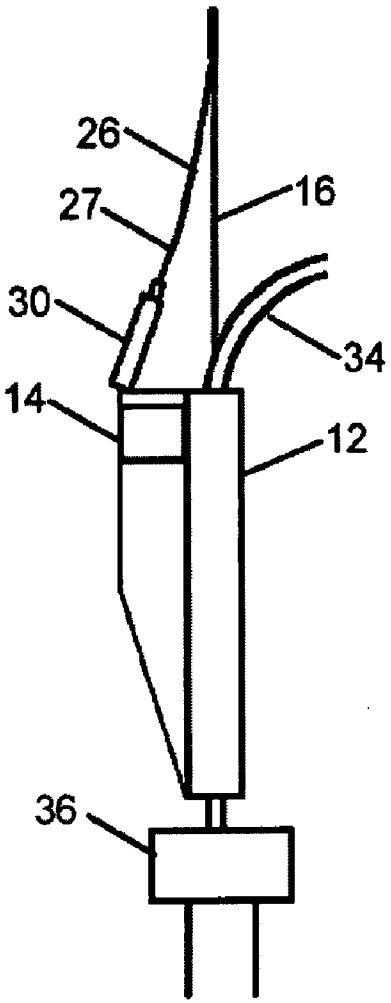
FIG. 5 is a side view of the continuous well string injection unit with the pneumatic cylinder extended and the rod in the well.
Figure 4:
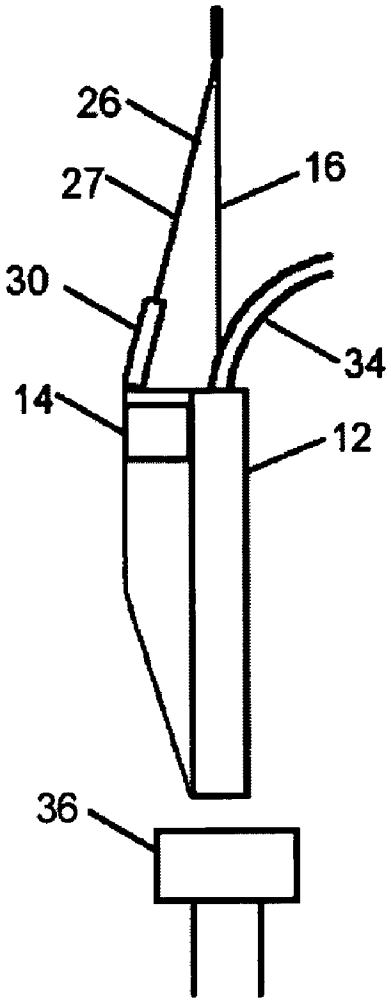
FIG. 4 is a side view of the continuous well string injection unit with the pneumatic cylinder retracted.
Figure 3:
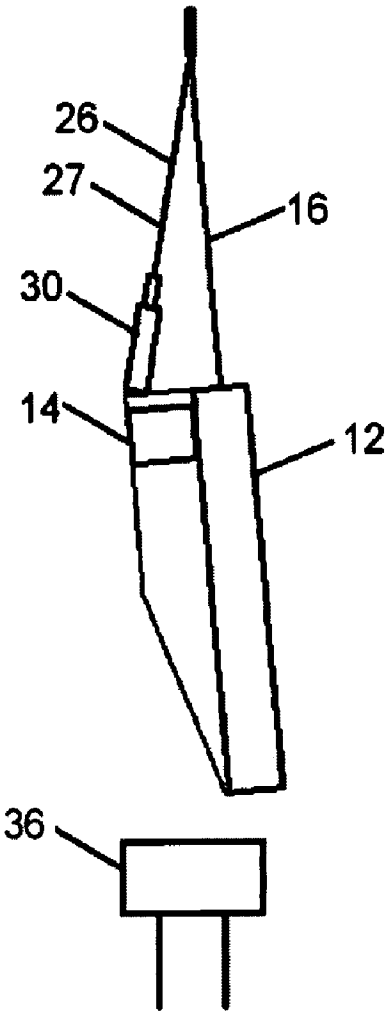
FIG. 3 is a side view of the continuous well string injection unit with the pneumatic cylinder extended.

Referring now to FIG. 3, because of the position of motors 14 on one side of injection unit 12, injection unit 12 is unbalanced and will not be centered over the well 36. Once the rod 34 is in well 36 and injection unit 12 is in operation, unbalancing is no longer a problem since the load on the injection unit 12 far exceeds any load created by the weight of the motors 14. However, unbalancing of the injection unit 12 by the motors 14 is a problem until a load is placed on injection unit 12. Before a load is placed on injection unit 12 by operation of the injection unit 12 to insert rod into a well, pneumatic cylinder 30 can therefore be retracted as shown in FIG. 4 to position injection unit 12 properly over well 36. The operation of pneumatic cylinder 30 causes tension in positioner 26, which lifts the overweighted side of the injection unit 12 so that it is in a balanced position over the well 36. Rod may then be inserted into the well 36 and manipulated as desired. Once the injection unit 12 is in operation, it is undesirable to have sling 16 and positioner 26 all bearing a load as it may cause damage to the frame or one of the cables. Referring to FIG. 5, pneumatic cylinder 30 is extended again, with consequential loss of tension in cable 27, once the injection unit 12 is loaded, since with the load on the injection unit 12 there is no longer a need for positioner 26 to keep injection unit 12 in position. For simplification of the control system, full retraction of the cylinder 30 is chosen to correspond to the vertical position, while the fully extended position corresponds to the unloaded position of FIG. 5. The cylinder 30 is provided with activating fluid from the control lines leading to the controller (not shown).

Immaterial modifications may be made to the embodiments of the invention described here without departing from the invention. The continuous well string injection unit may be used for any continuous well string, but is particular suited to rod injection. The continuous well string injection unit may also be balanced by a rigid rod connected to the underweighted side with a hydraulic or pneumatically driven cylinder used to extend the rigid rod, but tensioning of a suspension member is preferred to compression of a rigid rod.

What is claimed is:

1. In a continuous well string injection unit:

having an axis along which continuous well string may be driven during operation of the continuous well string injection unit and a pair of suspension points, the continuous well string injection unit being unbalanced when suspended from the suspension points over a well such that the axis of the continuous well string injection unit is not aligned with the well; the improvement comprising:

a support point on the continuous well string injection unit, the support point being connectable to a support member that may be operated to balance the continuous well string injection unit and align the axis of the continuous well string injection unit with the well.

2. The continuous well string injection unit of claim 1 in which the pair of suspension points are connected to a sling and the support point is a third suspension point on an overweighted side of the continuous well string injection unit, the support point being connected to the support member.

3. The continuous well string injection unit of claim 2 in which the support member is length-adjustable.

4. The continuous well string injection unit of claim 3, wherein the support member comprises a pneumatic air cylinder and a cable.

5. The continuous well string injection unit of claim 4 in which the continuous well string injection unit is a continuous chain rod injector.

6. A method of suspending a continuous well string injection unit from a rig, the method comprising the steps of:

suspending a continuous well string injection unit over a well from a pair of suspension points, with the continuous well string injection unit being unbalanced due to having an overweighted side; and balancing the continuous well string injection unit prior to injecting continuous well string into the well.

7. The method of claim 6 in which the continuous well string injection unit is balanced by suspending the continuous well string injection unit from a third suspension point on the overweighted side of the continuous well string injection unit.

8. The method of claim 7 in which the pair of suspension points are connected to a sling and the third suspension point is connected to a support member.

9. The method of claim 8 further comprising the step of adjusting the length of the support member.

10. The method of claim 9 in which the length of the support member is adjusted during operation of the continuous well string injection unit to reduce the load on the support member.

* * * * *